United States Patent [19]

Ruscitti et al.

[11] Patent Number: 4,932,569

[45] Date of Patent: Jun. 12, 1990

[54] DEVICE, PARTICULARLY FOR A HAND PUMP, FOR DELIVERING A PREDETERMINED QUANTITY OF THICK OR LIQUID SUBSTANCES CONTAINED IN BOTTLES

[75] Inventors: Tommaso Ruscitti, Milan; Davide Cutilli, Penne; Demetrio De Leonardis, Spoltore, all of Italy

[73] Assignee: S.A.R. S.p.A, Chieti, Italy

[21] Appl. No.: 228,446

[22] Filed: Aug. 5, 1988

[30] Foreign Application Priority Data

Apr. 12, 1988 [IT] Italy ..... 20175 A/88

[51] Int. Cl.[5] ..... B65D 83/00

[52] U.S. Cl. ..... 222/402.24; 222/321; 222/514

[58] Field of Search ..... 222/321, 464, 514, 513, 222/382, 509, 559, 409, 402.24, 402.21, 402.2, 288, 282, 385, 384, 383, 372

[56] References Cited

U.S. PATENT DOCUMENTS

| | | | |
|---|---|---|---|
| 2,362,080 | 11/1944 | Martin | 222/321 |
| 2,565,954 | 8/1951 | Dey | 222/402.24 |
| 2,610,940 | 9/1952 | Endicott | 222/402.24 |
| 2,976,844 | 3/1961 | Goldring | 92/13.41 |
| 3,144,179 | 8/1964 | Gildone | 222/514 |
| 3,458,090 | 7/1969 | Scoggin | 222/309 |
| 3,862,741 | 1/1975 | Steiman et al. | 222/402.24 |
| 3,957,178 | 5/1976 | Steiman | 222/321 |
| 4,061,247 | 12/1977 | Meshberg | 222/321 |
| 4,434,916 | 3/1984 | Ruscitti et al. | 222/321 |
| 4,511,064 | 4/1985 | Ruscitti et al. | 222/153 |

FOREIGN PATENT DOCUMENTS

| | | |
|---|---|---|
| 8702986 | 5/1987 | Fed. Rep. of Germany . |
| 2573819 | 11/1984 | France . |

*Primary Examiner*—Kevin P. Shaver
*Assistant Examiner*—Kenneth Noland
*Attorney, Agent, or Firm*—Oblon, Spivak, McClelland, Maier & Neustadt

[57] ABSTRACT

A device particularly for a hand pump (1) for delivering a predetermined quantity of thick or liquid substances contained in bottles or containers (2). The pump (1) includes an overall tubular hollow main body (3) for receiving the operating members of the pump (1), including an operating stem (4) which projects from the outer end (21) of the hollow main body (3) and a retention element (9, 9A) for retaining the operating stem (4) within the hollow main body (3). The retention element (9, 9A) has a hole (8) through which the operating stem (4) passes and projections or recesses (13, 14) arranged to respectively snap-engage corresponding recesses or projections (14, 13) provided in or on the hollow main body (3). A hollow tubular appendix (16) is formed integrally with the retention element (9 9A) for the operating stem (4) and extends towards the interior (11) of the hollow main body (3) of the pump (1). The hollow tubular appendix (16) is arranged to cooperate with a collar (17) disposed on the operating stem (4) to limit its travel.

5 Claims, 1 Drawing Sheet

DEVICE, PARTICULARLY FOR A HAND PUMP, FOR DELIVERING A PREDETERMINED QUANTITY OF THICK OR LIQUID SUBSTANCES CONTAINED IN BOTTLES

FIELD OF THE INVENTION

This invention relates to a hand pump for delivering a predetermined quantity of a liquid substance, including atomized or micronized delivery, or of a thick substance contained in bottles or containers.

BACKGROUND OF THE INVENTION

Pumps of this type are well known and comprise essentially a main hollow body of circular cross-section composed of coaxial portions of different diameter and housing all the pump operating members, including a coaxial stem projecting from one of the open ends of the main body. The stem is operated to deliver the substance contained in the bottle.

Specifically, delivery is obtained by pressing axially with the hand, in the direction of the main body, on a suitable knob fixed to the end of the stem projecting from the main body. The stem is returned to its rest or non-delivery position by the action of a return spring when the axial pressing action ceases.

A pump of this type is the subject of a further patent application in the name of the present applicant filed on the same date. The pump disclosed and claimed in that application comprises an overall tubular hollow main body for receiving the pump operating members, including an operating stem which projects from one end of the main body, and an element for retraining the stem within the main body. The retention element comprises a hole through which the stem passes. The hole is provided with an abutment element acting against the retention element, and the retention element comprises projections or recesses arranged to respectively snap-engage corresponding recesses or projections provided in or on the main body.

A problem of known pumps is to adjust the delivered quantity of the thick or liquid substance contained in the bottle or container on which such pumps are mounted.

Many methods have been devised for obtaining metered delivery of the substance. One of these methods uses one or more spacer rings coaxial to and superposed on the stem. The spacer rings are arranged to maintain a minimum predetermined distance between the retention element and a collar provided on the stem. By varying the number of such rings, the axial stroke of the stem is varied to thus vary the quanitiy of the substance delivered, although always using the same type of pump.

This method requires the intervention of an operator who has to manually position the number of rings needed to obtain the delivery of a required predetermined quantity of substance.

This operatin is not always simple to carry out, mainly because of having to work in small spaces with small elements, namely, the spacer rings.

Additionally, this operation obviously leads to a considerable cost increase.

OBJECT OF THE INVENTION

An object of the invention is therefore to provide a device for delivering a predetermined quanitity of substance contained in a bottle while always using the same type of pump, by which the aforesaid drawbacks are obviated.

SUMMARY OF THE INVENTION

This and further ojects which will be apparent to the expert in the art are attained by a device applied to a hand pump of the aforesaid type, characterised by comprising means formed integrally with the operating stem retention element and extending towards the interior of the hollow pump body, which means are arranged to cooperate with the stem retention element to limit the stem travel.

The retention element is usually an annular collar coaxial to the stem.

BRIEF DESCRIPTION OF THE DRAWINGS

The present invention will be more apparent from the accompanying drawings, which are given by way of non-limiting example and in which.

DETAILED DESCRIPTION OF THE PRESENTLY PREFERRED EMBODIMENTS

The First Embodiment

Figure 1:
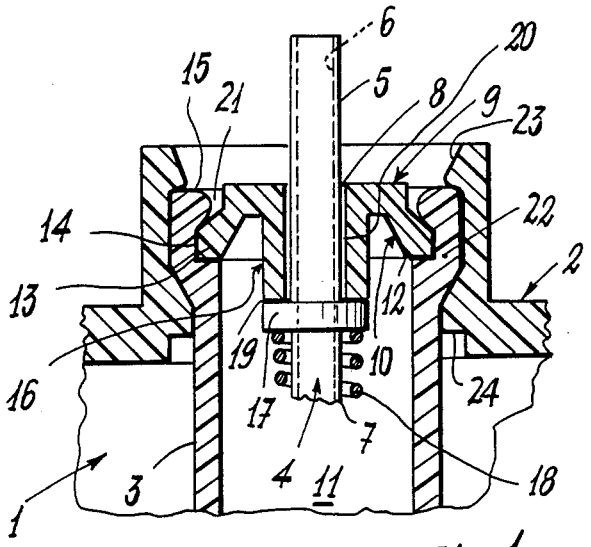
FIG. 1 is a partial axial section through a first embodiment of the device according to the invention, applied to a partly illustrated pump shown already fitted to the bottle or associated ring nut.

With reference to FIG. 1, the device according to the present invention is applied to a pump 1 inserted into the mouth of a bottle 2 or into the suitable ring nut which is then mounted on the bottle mouth. The pump 1 comprises substantially a hollow main body 3 consisting of a single tubular element (of which only the upper part is visible in FIG. 1) formed from coaxial portions of different diameter. The main body 3 contains all the operating members of the pump 1, of which FIG. 1 shows only part of the coaxial operating stem 4. The upper part 5 of the operating stem 4 projects upwardly from the main body 3, passing through a hole 8 provided in a retention element 9 in the form of a cap positioned to close the outer end 21 of the hollow main body 3. The operating stem 4 also comprises an inner coaxial channel 6 through which the substance contained in the bottle 2 passes during its delivery.

The operating stem 4 comprises a lower part 7 contained within the hollow main hollow main body 3. The retention element 9 comprises a rim 10 extending towards the interior 11 of the body 3 and having on its end portion 12, which lies within the hollow main body 3 and annular protuberance 13 arranged to snap-engage in a corresponding annular recess 14 provided in proximity to the upper edge 15 of the hollow main body 3.

The device according to the present invention comprises a hollow tubular appendix 16 formed integrally with the retention element 9 so that it extends towards the interior 11 of the hollow main body 3. The hollow tubular appendix 16 is provided with a cavity 20 in which the operating stem 4 slides. The hollow tubular appendix 16 is arranged to cooperate with an abutment element or collar 17 provided on the operating stem 4 to limit the axial travel of the operating stem 4 away from the bottle 2 after operating the pump 1. An annular gasket (now shown) can be provided between the collar 17 and the hollow tubular appendix 16.

The pump 1 is operated, and thus the substance contained in the associated bottle 2 delivered, by pressing the upper part 5 of the operating stem 4 downwards in known manner by way of a suitable element, not shown. As stated heretofore, this causes the substance contained in the bottle 2 to emerge through the inner channel 6 of the operating stem 4. A compression spring 18 acting on the collar 17 and coaxial to the operating stem 4 returns the operating stem 4 to its rest position when the pressure on the upper part 5 of the operating stem 4 ceases. The axial return travel of the operating stem 4 away from the bottle 2 ceases when the collar 17 comes into contact with the end part 19 of the hollow tubular appendix 16.

By dimensioning the hollow tubular appendix 16 differently so that it extends into the hollow main body 3 by different distances according to requirements, the same pump can be made to deliver different quantities of substance on operating the pump. In this respect, the further the hollow tubular appendix 16 extends into the hollow main body 3, the shorter the axial stroke of the operating stem 4 when pressed on its upper part 5, and thus the smaller the quantity of substance delivered on operating the operating stem 4.

Thus in order to obtain different delivered quanitites of substance, the manufactured pumps 1 can be all identical with the exception of their retention element 9, the hollow tubular appendix 16 of which must extend into the hollow main body 3 by different distances. It is sufficient therefore to have available a series of retention elements 9 with hollow tubular appendices 16 of different lengths, the retention element with the tubular appendix corresponding to the required quantity of delivered substance then being mounted on the pump, the pump in other respects being always the same.

Finally, to enable the pump 1 to be fitted to the bottle 2 or to a ring nut which is then fitted to the bottle, the pump comprises an annular enlargement 22 on the hollow main body 3 in proximity to its upper edge 15 to snap-engage between two corresponding circular ribs 23 and 24 provided in the mouth of the bottle or associated ring nut.

THE SECOND EMBODIMENT

Figure 2:
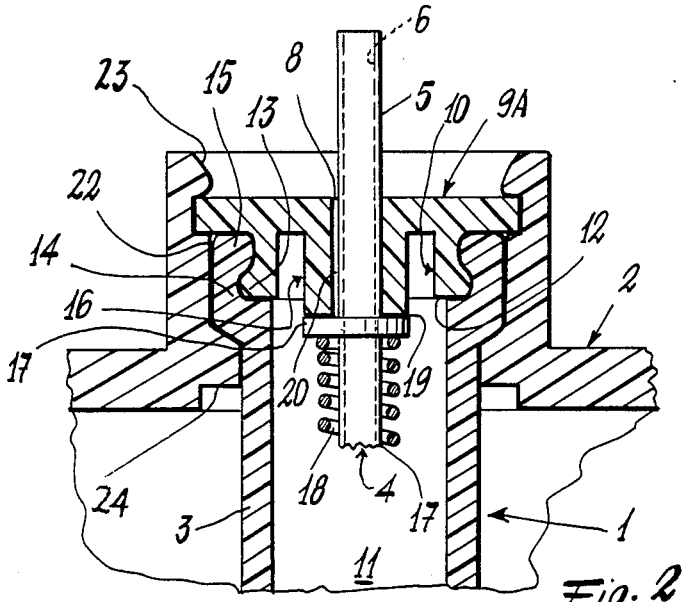
FIG. 2 is similar to FIG. 1 but shows a second embodiment of the invention.

In the embodiment shown in FIG. 2, parts corresponding to those of FIG. 1 are indicated by the same reference numerals. Specifically, the retention element 9A has a shape resulting substantially from combining a retention element of the known art (which engages directly with the mouth of the bottle 2 or the associated ring nut) with the retention element 9 of FIG. 1. The retention element 9A of FIG. 2 also has a hollow tubular appendix 16 integral with retention element 9A itself and arranged to cooperate with a collar 17 provided on the operating stem 4. The hollow tubular appendix 16 and the collar 17 define a device for adjusting the quantity of substance delivered by the pump 1 which is analogous to that described heretofore, and is therefore not further described.

ADVANTAGES OF THE INVENTION

The device according to the invention enables a pump to be obtained which, very advantageously, can be completely assembled by machine, including the specific retention element for the required quantity of delivered substance, with a substantial reduction in the pump production cost. The bottler can therefore be provided with a complete pump which he does not have to assemble and which is able to deliver the required quantity of substance, the pump being ready for fitting to the bottle or associated ring nut, with further substantial saving.

The device according to the invention can be easily constructed by moulding integrally with the retention element.

We claim:

1. A hand pump for delivering a predetermined quantity of a substance contained in an enclosure, said hand pump comprising:

(a) a hollow main body having:
  (i) an open outer end and
  (ii) an inwardly open annular recess near said open outer end;

(b) a plurality of retention elements, each one of said plurality of retention elements being detachably mountable in said open outer end of said hollow main body, each one of said plurality of retention elements having:
  (i) a tubular appendix that projects into said hollow main body by a predetermined amount;
  (ii) a hole that extends through said tubular appendix and that is open on both sides of said retention elements; and
  (iii) a radially outwardly projecting annular protuberance received in said inwardly open annular recess in said hollow main body, said tubular appendices of said plurality of retention elements having different axial lengths, whereby the predetermined quantity of a substance contained in the enclosure delivered on operation of said hand pump can be varied by mounting different ones of said plurality of retention elements in said hollow main body;

(c) an operating stem:
  (i) that is slidably receivable in said holes in said plurality of retention elements;
  (ii) that projects outside the one of said retention elements in which it is received; and
  (iii) that contains an inner channel;

(d) a collar projecting from said operating stem on the inside of said hollow main body, said collar having a first surface that abuts against said tubular appendix to limit axial movement of said operating stem in one direction; and (e) a compression spring bearing against a second surface of said collar to bias said operating stem toward said tubular appendix.

2. A hand pump as recited in claim 1 wherein said retention elements are snap fit in said hollow main body.

3. A hand pump as recited in claim 1 wherein said hollow main body has a radially outwardly projecting annular protuberance at its open outer end sized, shaped, and positioned to be received in a corresponding annular recess in the enclosure.

4. A hand pump as recited in claim 1 wherein each one of said plurality of retention elements has a radially outwardly projecting annular protuberance sized, shaped, and positioned to be received in a corresponding annular recess in the enclosure.

5. A hand pump as receited in claim 4 wherein said hollow main body has a radially outwardly projecting annular protuberance sized, shaped, and positioned to be received between a radially outwardly projecting annular protuberance on the one of said plurality of retention elements in which it is received and radially inwardly projecting shoulder in the enclosure.

* * * * *